United States Patent [19]

Ogden et al.

[11] Patent Number: 4,928,332

[45] Date of Patent: May 29, 1990

[54] ADJUSTABLE MATTRESS FOUNDATION FOR BEDS

[76] Inventors: Ralph Ogden, 1304 Fisher Street, Munster, Ind. 46321; Heikki Huik, 227 Washington Street, Rensselaer, Ind. 47978

[21] Appl. No.: 268,078

[22] Filed: Nov. 7, 1988

[51] Int. Cl.[5] ..... A61G 7/015; A61G 7/018

[52] U.S. Cl. ..... 5/68; 5/72; 5/308

[58] Field of Search ..... 5/68, 67, 66, 69, 70, 5/72, 60, 308

[56] References Cited

U.S. PATENT DOCUMENTS

| | | | |
|---|---|---|---|
| 3,245,092 | 4/1966 | Kreuz | 5/68 |
| 3,604,024 | 9/1971 | Polanski . | |
| 4,097,940 | 7/1978 | Tekulve et al. | 5/66 |
| 4,373,707 | 2/1983 | Molders | 267/120 |
| 4,398,313 | 8/1983 | Mitchell | 5/66 |
| 4,489,449 | 12/1984 | Failor et al. | 5/68 |
| 4,589,151 | 5/1986 | Behrens | 5/68 |
| 4,691,393 | 9/1987 | Kuck | 5/62 |
| 4,751,755 | 6/1988 | Carey, Jr. et al. | 5/72 |

FOREIGN PATENT DOCUMENTS

| | | | |
|---|---|---|---|
| 1485485 | 6/1967 | France | 5/68 |
| 6512766 | 4/1967 | Netherlands | 5/70 |
| 0166614 | 4/1981 | Netherlands | 5/70 |

*Primary Examiner*—Alexander Grosz

*Attorney, Agent, or Firm*—Lee, Mann, Smith, McWilliams & Sweeney

[57] ABSTRACT

An adjustable mattress foundation for beds, having head, and foot sections of adjustable inclination, and a stationary center section for supporting the user's buttocks, with locking gas springs being employed as force providers and counterbalances in selectively adjusting the angle of inclination for the head and foot sections, with the actuation of the head and foot sections being effected by the pivoting a single control rod. Changes can be made in the torque application of the device on the foundation head and foot sections for different weights and stiffnesses of mattress by a simple adjustment. The width of the stationary section has a minimum width requirement in order to minimize the force required to make changes in inclination in the head and foot sections with respect thereto, and have minimum stress exerted on the mattress.

10 Claims, 5 Drawing Sheets

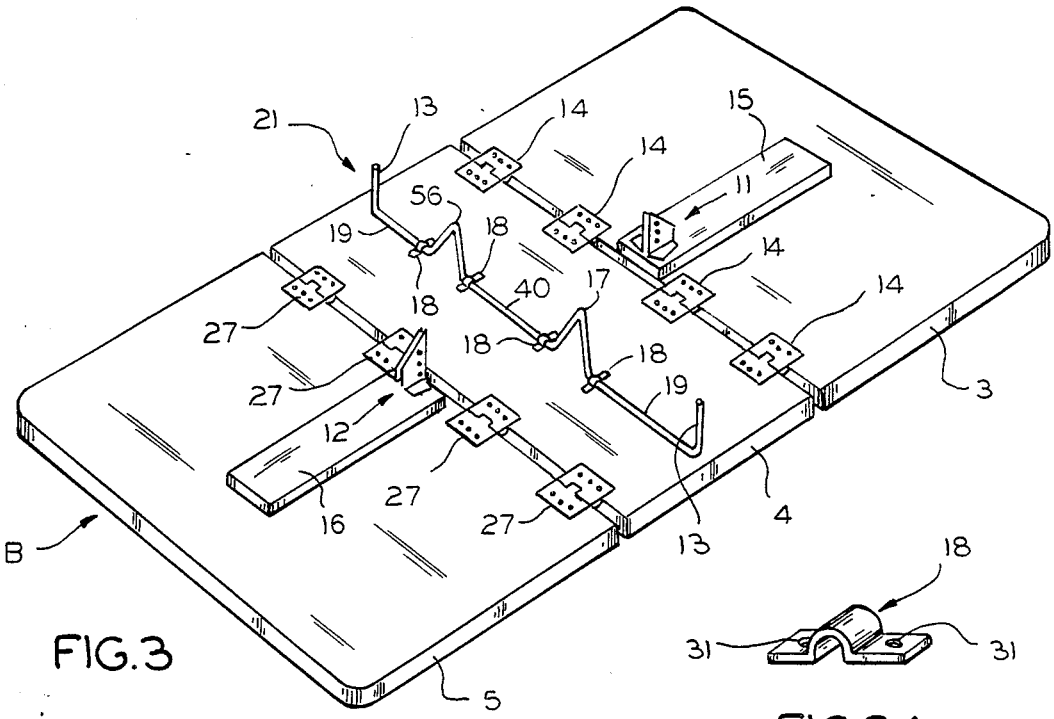
FIG.3
FIG.3A
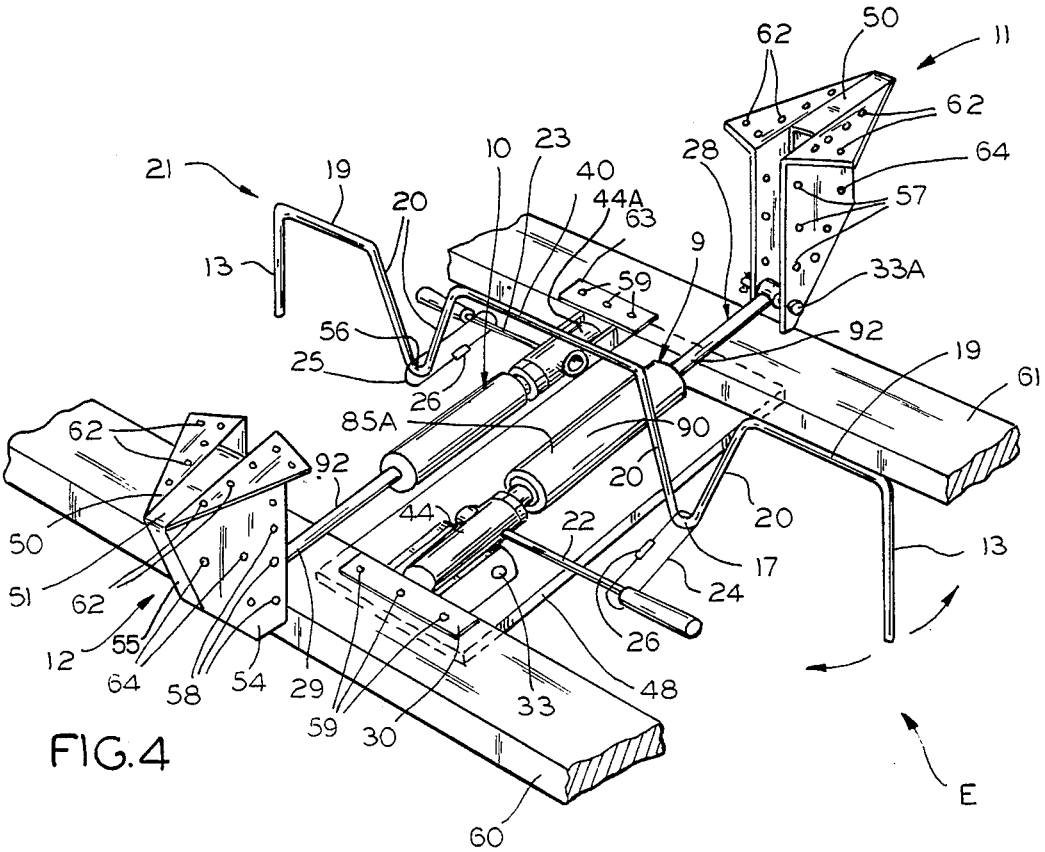
FIG.4

ADJUSTABLE MATTRESS FOUNDATION FOR BEDS

This invention relates to what are generally known as adjustable beds that are found in some hospitals, nursing facilities and in some homes, and more particularly, to an adjustable mattress foundation for beds that when employed, as disclosed herein, in connection with a mattress and bed support frame or platform, provides an adjustable bed.

So-called adjustable beds that are commonly found in hospitals, nursing homes, retirement facilities, and some private homes, are well known. Adjustable beds in practice involve an underlying bed foundation that is in the form of sections of rigid or semi-rigid material that are of adjustable inclination at the head and foot of the bed, upon which the familiar bed mattress is placed and used for sleeping. The head end of the bed can be raised about a pivoting center, so that the body of the person resting on the mattress is elevated from the hips upward. The foot end of the bed can be raised in a similar manner, or it can be constructed to have a double action, with the legs from the foot to the knees remaining approximately horizontal as the legs are raised. As is also well known, the raising of the head and foot ends of the bed can either be done manually or by powered devices. If the action involved is powered, it is typically powered by electric motors, one for the bed head end and one for the bed foot end, with the controls being normally enclosed in a remote housing that is either hand held or permanently mounted at the side of the bed. If the action of raising the head and foot ends of the bed is manual, typically it is provided for by means of hand crank screws, one for each end of the bed, with the crank handles, typically mounted side by side, and being usually located on the lower part of the bed at the foot end. Such bed frames of both the manual and the powered adjustable bed types are usually made of steel with the mattress mounted upon them usually being without a stiff border wire, especially at the locations where the bends are to take place. Both the manual and powered types of adjustable mattress foundations are expensive, noisy and slow in action.

A principal object of the present invention is to provide an adjustable mattress foundation for beds, on top of which a mattress is to be applied, that comprises three articulated planar sections that may be formed from particle board or the like, of which the center section is to be stationarily fixed against movement, and substantially horizontally disposed in use, and the foundation head and foot sections may be selectively moved by, for instance, the bed user, whether on or off the bed, from substantially coplanar relation with the foundation center section, in which relation the bed mattress lies horizontal for normal sleeping use, to upwardly inclined positions, as to the head section or the foot section, or both, as desired, by using a simple activating member in a rotational manner, and which can be actuated from either side of the bed, which results in the bed section inclination desired.

Another principal object of the present invention is to provide an adjustable mattress foundation for beds, on top of which a mattress is to be applied, that comprises three articulated planar sections in which the center section is to be stationary, fixed in place on the bed support, and substantially horizontally disposed in use, and the head and foot sections may be selectively moved by, for instance, the bed user, whether on or off the bed, from a coplanar relation with the center section of the foundation, to upwardly inclined positions, as to one or both of the foundation inclinable sections, as desired, by using a single activating member in a pivotal or rotational manner, and from one side of the bed, with automatic retention of the foundation head and foot sections, and thus the bed head and foot ends, at exactly the inclination to which the underlying foundation section in question has been raised, and which has been achieved by the bed user merely releasing the foundation section activating member, and also to permit ready return of the foundation and mattress, and thus the bed, to the usual horizontal relation, using the same controls, but in a counterbalance manner.

In accordance with the invention a new type of adjustable mattress foundation is provided having adjustable head and foot sections pivotally secured to a stationary center section, using a locking gas spring device for each of the respective head and foot sections for supplying the force needed that is applied to a torque providing bracket that is suitably anchored to the foundation respective head and foot sections, and using a single crank arm type control rod that effects the indicated operation of the respective locking type gas springs for not only inclining the head or foot sections, depending on the direction of rotation of the crank arm, but also providing for automatic retention of the head or foot section in the desired position of inclination by merely releasing the crank arm, with the locking gas springs also acting as energy storage devices for generating the upward arcuate movements of the head and foot sections of the mattress foundation that are desired.

The locking gas spring devices are attached in a unique manner to the underside of the foundation so that the force on the foundation sections they actuate provides a torque on same that makes their lifting capacity for various stiffness and weights of mattresses changeable by simple and easy to make adjustments at the underside of the foundation.

The fixed central section of the mattress foundation which is normally that which the patient's buttocks rests upon through the mattress, is preferably of a minimum width that allows the mattress that rests on it to have two complete bends, one for the head end of the bed, and one for the foot end of the bed. This minimum width allows the mattress to be bent with very little kinking as the foundation head and foot sections are upwardly inclined, and have a relatively small amount of stress as the mattress bends as it follows the angular movement of the foundation head and foot sections. Experience acquired in developing the invention shows that this minimum width is approximately fourteen inches.

The locking gas spring device crank rod that serves as the control implement for the mattress foundation of this invention extends crosswise of the bed at the foundation center section, and is operable from either side of the bed; acts to control both the head end and the foot end locking gas spring devices that are separately employed for inclining the foundation head and foot sections, and operates in a manner which is easy to use and requires very little effort by the user. The single control member is formed from a single rod in one piece form with, preferably, an operating handle at each of its ends, one disposed on each side of the bed, for pivotal actuation of the control rod whereby the locking gas spring devices provided for the positioning of the foundation respective head and foot sections for modification of the positioning of the bed head and foot are made operative to permit the desired change in the inclinable foundation sections.

The general arrangement involved contemplates that two of these mattress foundations can be placed side by side, making a king or queen sized bed with individual controls for each of the bed sides. For this type of arrangement, only the control handle on the side away from where the two beds are next to each other would be used. As the control rod employed is of one piece, integral, relation, actuation of the handle on one side of the foundation effects actuation of the handle on the other side of the foundation, rotational movement being contemplated by the present invention.

The locking gas spring devices employed may be of the type that have a piston operating in a cylinder and actuating a piston rod, with the piston forming spaced chambers in the cylinder, the latter having a charge of captivated compressed gas, usually dry nitrogen. The gas spring devices, which are, as hereinafter disclosed, conventional items that have energy output in one direction, that is, they can be operated to bias the device piston rod outwardly of the cylinder, and thus require energy input to be operable in the opposite direction. Such devices are usually used as counterbalances or actuators. These devices include for actuation of same internal passaging and porting, as well as a readily actuated activating valve, which, when closed, effectively locks the gas spring arrangement involved to provide for an economically effective means for both adjusting the angle of inclination of the foundation head and foot sections using the single control lever arrangement of the present invention, and locking the head and foot sections in their selected positions. They also may be readily actuated to effect return of the foundation head and foot sections toward or to coplanar relation with the foundation center section, and thus return of the mattress to its totally flat relation, by the operator in effect biasing the foundation section involved to contract the gas spring device.

The adjustable mattress foundation arrangement of the present invention is arranged to employ wood or wood byproducts as the prime structural members. The bed as disclosed herein comprises a lower main framework on which the mattress foundation and mattress rest, which lower framework preferably uses conventional wood structural members joined together, as by using threaded fasteners and/or wood glue.

Other objects, uses, and advantages will be obvious or become apparent from a consideration of the following detailed description and the application drawings in which like reference numerals indicate like parts throughout the several views.

In the drawings:

FIG. 1 is a diagrammatic side elevational view of a preferred form of adjustable mattress foundation in accordance with the present invention, as supported by a framework which rests on the floor or other suitable supporting purpose, and in effect houses the bed head and foot force applying mechanisms, with a typical mattress being shown as applied to the adjustable mattress foundation of this invention, and with the head and foot sections of the foundation being shown in dashed lines in typical adjusted positions;

FIG. 2 is a perspective view of only the framework or platform on which the adjustable mattress foundation of the present invention and the mattress therefore are shown applied to in FIG. 1, with parts broken away to expose other parts, and on a reduced scale;

FIG. 3 is a bottom perspective view of the adjustable mattress foundation assembly of the present invention (shown in upside down relation), and in the form shown in FIG. 1, with the foundation sections being shown in flat or non-elevated, coplanar relation, better illustrating the force providing locking gas spring device control rod and its handles, and with the locking gas spring devices themselves for the foundation head being omitted for better illustrating the other component parts shown in FIG. 3;

FIG. 3A is a detail perspective view of one form of bracket illustrated in FIG. 3;

FIG. 4 is a top perspective view of the adjustable mattress foundation actuation arrangement of the present invention, with the foundation sections themselves and the mattress being omitted, and with the locking gas spring devices employed for the mattress foundation head and foot sections being illustrated, together with their manner of securement to the framework or platform on which the foundation is applied (to form an adjustable bed, see FIG. 1);

Figure 10:
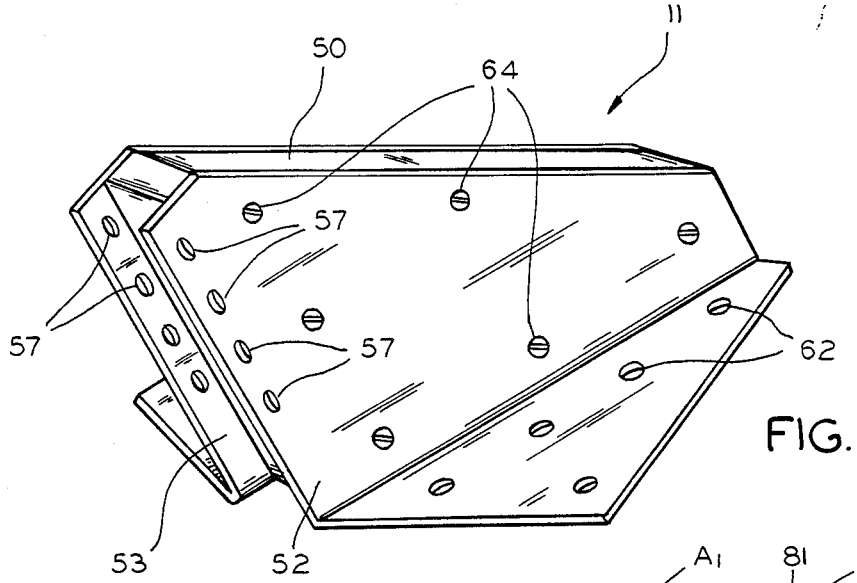
Figure 12:
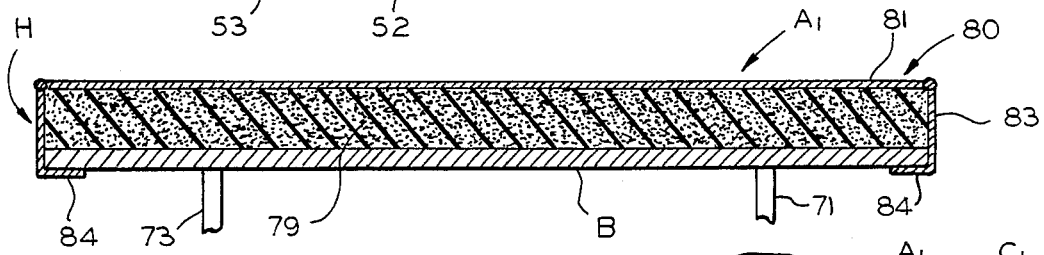
Figure 11:
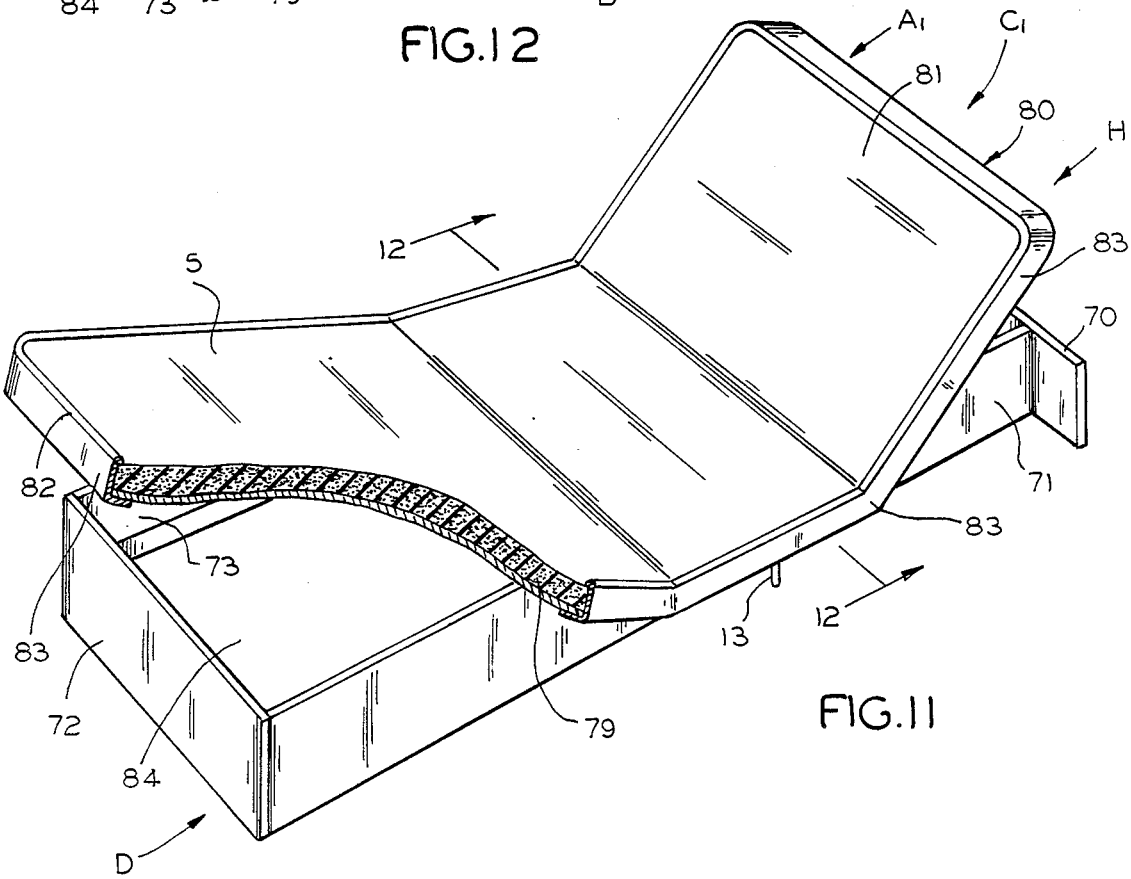

FIG. 10 is a perspective view illustrating the bracket arrangement as employed in connection with the respective head and foot sections of the foundation for translating the force applied thereto by the respective locking gas spring devices, in accordance with the invention, to torque which shifts the mattress respective head and foot sections, and thus the bed head ad foot, to upwardly inclined relations;

FIG. 11 is a perspective view of another embodiment of the invention in which a foam base is applied to the adjustable mattress foundation; and FIG. 12 is a transverse cross-sectional view through the mattress and foundation shown in FIG. 11.

However, it is to be distinctly understood that the drawing illustrations referred to are provided primarily to comply with the disclosure requirements of the Patent Laws, and that the invention is susceptible of modification and variations that will be obvious to those skilled in the art, and that are intended to be covered by the appended claims.

GENERAL DESCRIPTION

Figure 1:
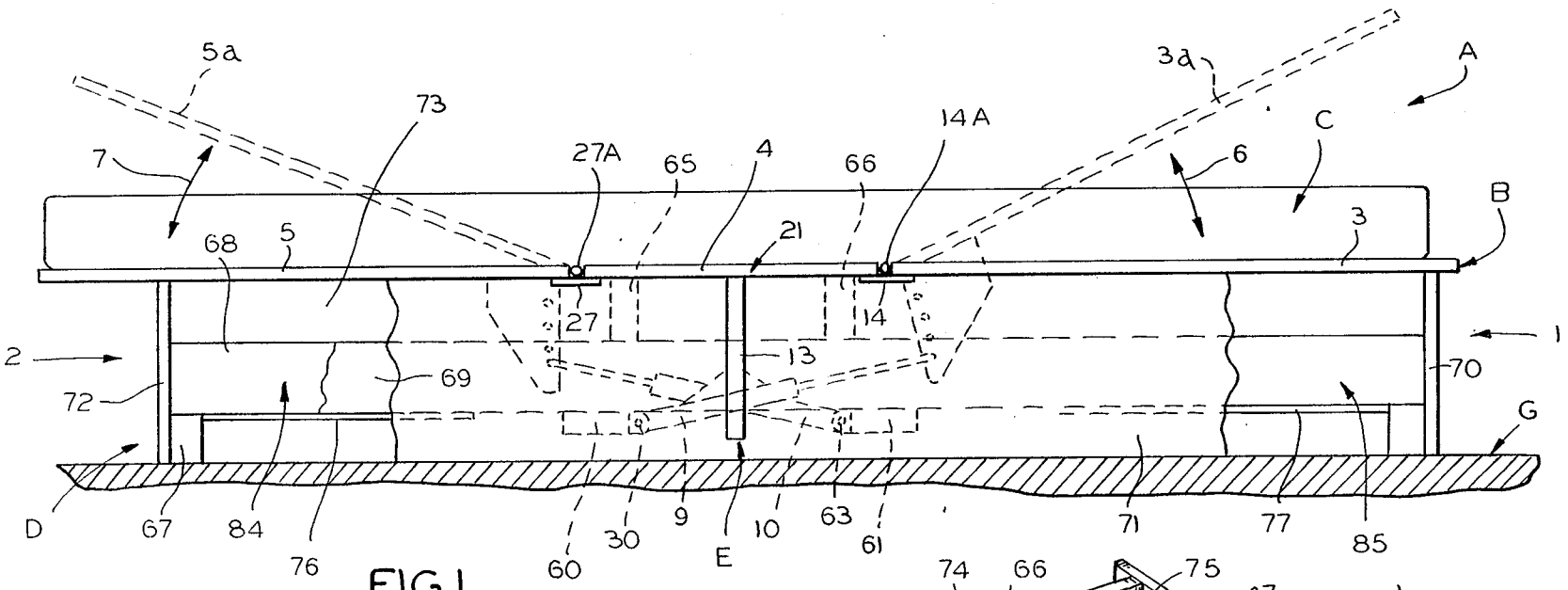

In the showing of FIG. 1, reference numeral 1 generally indicates the head end of the adjustable bed A, and reference numeral 2 generally indicates the foot end of such bed A. In the full line showing of FIG. 1, the adjustable mattress foundation B as illustrated is shown in the horizontal position, with the foundation comprising head section 3, a central section 4, and a foot section 5, which in the full line showing of FIG. 1, are oriented to be in essentially coplanar relation. In such relation a suitable mattress C, which may be of any conventional type, is to lie essentially flat on foundation B, with foundation B being supported by suitable frame or platform D, that rests on the diagrammatically illustrated floor G, to complete the adjustable bed A.

As indicated by the double headed arrow 6, the foundation head section 3, in accordance with the present invention, can be raised or lowered in the arcuate path indicated by the double headed arrow 6, about the axis 14A of the hinges 14 (see FIG. 3), with the present invention contemplating that the head section 3 can be stopped at any position within its permissible range of adjustment and locked in that position by the locking gas spring device 9 that acts on this section 3, whereby the foundation section 3 may be disposed, for instance, at its dashed line position that is indicated by reference numeral 3*a* of FIG. 1.

Similarly, the foundation foot section 5 can be raised or lowered in the arcuate path indicated by the double headed arrow 7, with the movement in the case of the foot section 5 being about the axis 27A of hinges 27. Reference numeral 5*a* generally indicates the foot section 5 (of foundation B that has been raised to the position shown in dashed lines.

The indicated optional positioning of head section 3 and foot section 5 is made in accordance with the practice of the invention by utilizing one of the control arm 21 handle portions, shown in the form of control handles 13, in the form of FIGS. 1–6; handles 13 are shown diagrammatically at E in FIG. 1 (but see FIGS. 3 and 4).

In this connection, the Applicants have found that inclination adjustment of up to about 45 degrees angulation is desirable for the head end 1 of the bed, and up to about 20 degrees angulation is desirable for the foot end 2 of the bed, but obviously the angulation permissible for each foundation section may be larger or smaller as desired.

Central section 4 of the mattress foundation B is at the position of the adjustable bed where the user (normally a patient of a hospital or the like) normally disposes his or her buttocks (hereinafter referred to generically as his) in lying on the adjustable bed A.

For this purpose the foundation section 4 is suitably affixed to the framework or platform D to which the foundation B and mattress C are applied to form the adjustable bed A, as by employing screws or the like (not shown) to anchor section 4 to framework or platform D.

As has been indicated, FIG. 3 is a perspective view diagrammatically illustrating the underside of the adjustable mattress foundation B of the present invention, with the actuating locking gas spring devices 9 and 10 employed as foundation section actuators being omitted. The foundation sections are more fully illustrated in FIG. 3 as comprising three essentially rectangular, essentially planar bodies 3, 4 and 5, that in the upright relation shown in FIG. 1, when in coplanar relation (as shown in full lines in FIG. 1) define the essentially planar surfacing upon which a suitable mattress C is to be placed. The sections 3, 4 and 5 are preferably made from medium density particle board (particle board comprises wood particles combined with an adhesive, and then cured with heat and pressure in a press), with a suitable thickness dimensioning being $\frac{3}{4}$ of an inch, which sections are joined together by the respective sets of hinges 14 and 27, as shown in FIG. 3. The three foundation sections 3, 4, and 5 when joined by the respective sets of hinges 14 and 27, approximate in joint configuration the shape of the mattress that will be placed on same, as indicated by FIG. 1. The respective sets of hinges 14 and 27 receive suitable screws which fasten them to the respective sections 3, 4, and 5, with such screws being omitted from the showing of FIG. 3 to simplify the drawing.

As to the head end 1 of the bed, in the illustrated embodiment the foundation head section 3 is provided with an elongate reinforcement pad 15 along its midportion of the underside of the indicated section 3 (see FIG. 3). The foot section 5 has a similar reinforcement pad 16. The pads 15 and 16 are preferably of the same type of particle board as the foundation sections 3, 4, and 5, and of the same thickness, and are secured to the respective sections 3 and 5 by using suitable bonding techniques as wood glue, in a preferred arrangement. Pads 15 and 16 are of identical planar rectangular configuration in the form illustrated.

The respective brackets 11 and 12 that apply the needed torque to the respective foundation sections 3 and 5 to move same are likewise secured to the respective reinforced pads 15 and 16 in any suitable manner, as by employing wood screws or the like. The reinforcement pads 15 and 16 have been found to significantly increase the strength of the respective foundation sections 3 and 5, and decrease the deflection of such sections brought about by the weight of a person lying on the bed A being concentrated at these locations (other than the part of the patient's weight supported by the non-moving foundation section 4).

As indicated in FIG. 4, locking gas spring device or actuator 9 is employed to provide the desired inclination to the bed head end foundation section 3, while the locking gas spring device or actuator 10 is employed for the same purpose in connection with the foundation section 5, in the illustrated embodiment.

Figure 9:
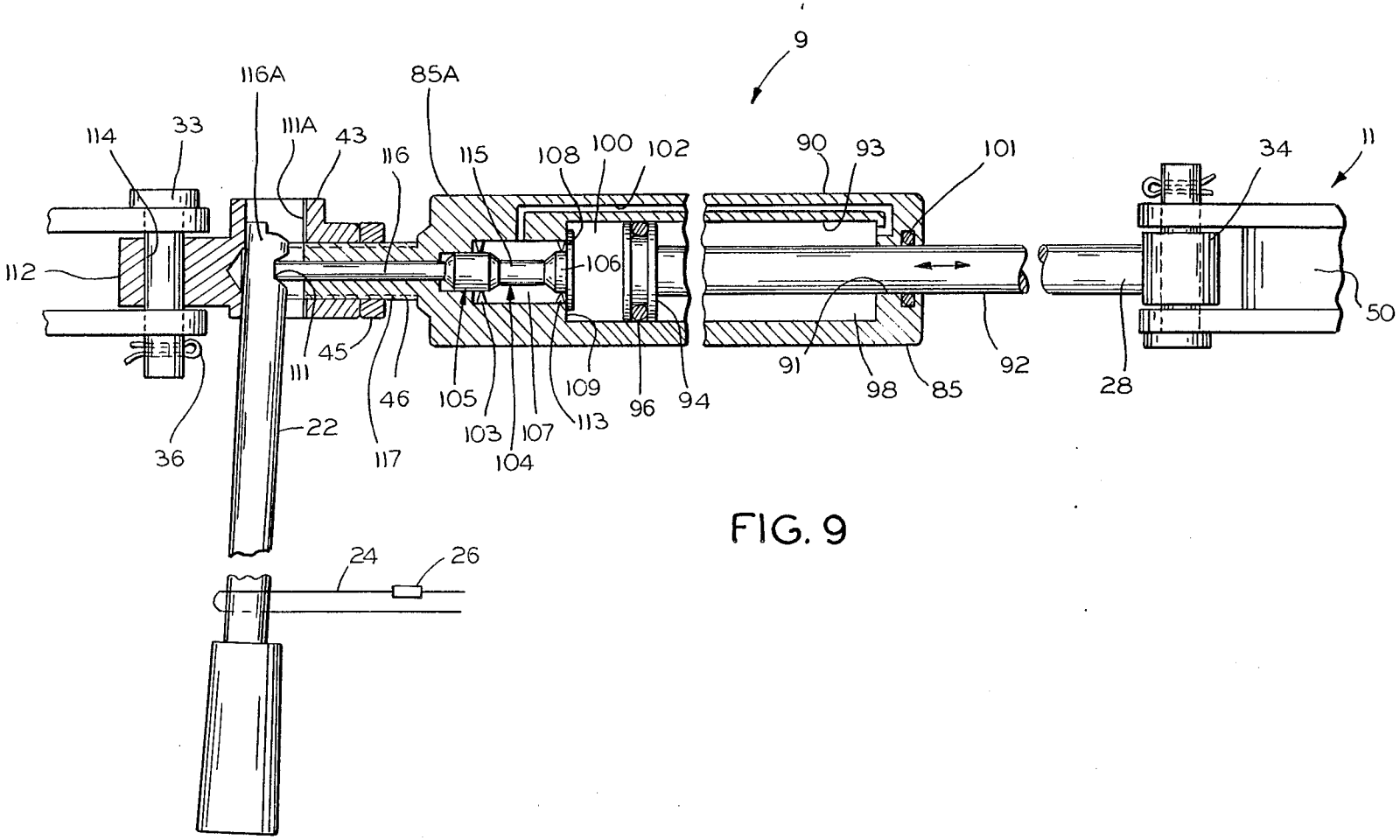
FIG. 9 is a diagrammatic longitudinal cross-sectional view through one of the locking gas cylinder devices of the illustrated embodiment, indicating the nature of same.

The locking gas spring devices 9 and 10 are identical in arrangement, are readily available "off the shelf" items (they being manufactured by a number of companies), and are diagrammatically illustrated in FIG. 9. Suspa, a European Company, that has its U.S. sales outlet Suspa, Inc. at Grand Rapids, Mich., for instance, is one company that offers gas spring devices of this type, which devices are diagrammatically illustrated by the showing of FIG. 9 for completeness of disclosure purposes (FIG. 9 specifically shows device 9, but device 10 is similarly arranged). Another suitable device of this type that is of different arrangement but functionally the same is offered by Gas Spring Corporation, of Colmar, Pa.

Figure 6:
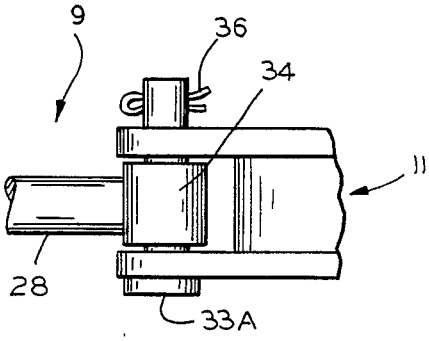
FIG. 6 is a diagrammatic fragmental view indicating the manner in which, for the illustrated embodiment, the piston rod end, of the respective locking gas spring devices, is connected to the respective underside actuation brackets of the respective foundation head and foot sections.

As indicated in FIG. 9, the devices 9 and 10 each comprise a cylinder 90 formed to define a cylindrical chamber 93 in which suitable piston 94 reciprocates, with the piston 94 being equipped with suitable packing 96 and being suitably fixed to piston rod 92 that in the case of the present invention is attached to one of the respective actuation brackets 11 and 12 in the manner indicated in FIG. 6 for bracket 11. This is at the end 28 of the device 9 where the thrust of the piston rod 92 is converted into torque for actuation the foundation head section 3. The piston 94 defines subchambers 98 and 100 on either side of same, and the cylinder 90 is formed to define internal passage 102 through which gas of the gas charge flows between the chambers 98 and 100 on appropriate positioning of the valve 104.

The valve 104 includes elongate radially enlarged cylinder section 105 and similar relatively short section 106 that has affixed thereto flange 108 that abuts against the wall 109 of cylinder 90 when the valve sections 105 and 106 are in sealing relation with the respective conventional mechanical packings 103 and 113; flange 108 services as a stop to limit the travel of valve 104 outwardly of chamber 107 (and thus to the left of the showing of FIG. 9). Conventional packing 101 seals chamber 98 at piston rod slideway 91 from leakage of the gas charge to atmosphere about piston rod 92. The piston 94 is conventionally equipped with sealing packing 96. The devices 9 and 10 each include a valve actuation rod 116 that is slidably mounted in cylinder neck 46 and is to act against the end of valve section 105 to operate the respective devices 9 and 10. In the case of device 9, this is effected by handle 22 and its rocking engagement with end 116A of rod 116 to effect movement of rod 116 to the right of FIG. 9 to open chamber 98 to chamber 100 via passage 102, chamber 107, and the annular orifice defined by valve 104 and packing 113 when valve section 106 is separated from packing 113 by the movement involved, valve section 105 being long enough so that a continuous gas sealing contact is maintained with packing 103. In the showing of FIG. 9, the device 9 is in its locked relation.

Reference numeral 111 indicates a notched portion of control arm 22 that is to shift rod 116 (to the right of FIG. 9) to shift valve 104 to its open position. Reference numeral 117 indicates a threaded extension of cylinder 90 forming neck 46 in which rod 116 reciprocates, and serves to provide a way of threadedly attaching adapter 43 to cylinder 90, with lock nut 45 being employed on neck 46 to seat adapter 43 at the correct position of adjustment for a particular bed A. Adapter 43 is apertured at 114 to receive pin 33, and at 111A to receive the engaging ends of rod 116 and handle 22. Rod 116 is biased to the left of FIG. 9 by valve 104, which is limited in movement (to the left of FIG. 9) by engagement of flange 108 against the cylinder annular wall 109. In practice, when setting up a locking gas spring 9 or 10 in accordance with the invention, adapter 43 is adjusted axially of cylinder 90 so that there will be a slight gap between the control arm notched portion 111 and the adjacent end of rod 116 (when valve 104 is not activated).

As is well known, the gas, usually dry nitrogen, is applied in a conventional manner to the cylinder 90 so as to fill the chambers 98 and 100, and under pressure, with the device piston 94 being retracted to be closely adjacent to the valve 104 in the fully retracted position of the device, and the subchamber 98 being under a significantly higher pressure (which may be as high as approximately 2,000 psi). As indicated, devices 9 and 10 are essentially leakage free because of packings 101, 103 and 113, packings 96 and 113 sealing internally of cylinder 90, and packings 101 and 103 sealing the cylinder 90 against loss of the gas charge to the atmosphere.

At this point a brief description of operation will make clear the nature of devices 9 and 10.

Assume handle 22 is pulled to the right (of FIG. 9), acting through cable loop 24 (see also FIG. 4) sufficiently to place the internal valve 104 in the open condition. Assume further that there is no weight on section 3. Gas will pass through the valve 104 and raise the head section 3 by the action of the gas being released from the chamber 98 and transferred to chamber 100 through passage 102 and valve chamber 107. It will continue doing so until the operator releases the control handle 13 (see FIG. 4, and as hereinafter disclosed) or the head section 3 reaches its upper limiting position, the end of the travel of the piston 94. If the control handle 13 is released before the end of he travel, to gravitate to the position of FIGS. 1 and 4, movement of the head section 3 upwardly will stop at that point. If the operator has the weight of his torso on had section 3, and places the valve 104 in the open position through the action of the control handle 13, cable loop 24 and arcuate movement of rod 22, then the piston rod 92 will move to the left of FIG. 9, whereby piston 94 forces gas out of chamber 100, through the valve 104, through chamber 107, through passage 102 and back into chamber 98. At any point, the operator can release the handle 13, returning control rod 21 (see FIG. 4) back to the position of FIG. 1. The movement of gas in the gas spring will then discontinue and the movement of the head section 3 will stop. With the valve 104 released, the operator can thus select any position within the adjustment range, up or down, that he (if he is the patient) chooses for his own personal comfort. In the released condition, the valve 104 is forced by the pressure in chamber 100 to the left to its fully sealing relation, with the flange 108 against wall 109.

The following will show how the pneumatically locked gas spring can be a safety feature. Assume the bed is subjected to a potentially unusual strain such as someone attempting to sit down on either the foot or head section when those sections are in an elevated condition. This can cause high stresses in the head or foot sections of the bed because the head and foot sections are in effect cantilevered from the respective rows of hinges. It is anticipated that users of the bed A will be cautioned against sitting on the bed head or foot section when they are in an elevated condition but this is an eventuality that can not be completely guarded against. With the pneumatically locking gas springs illustrated, the pressure in chamber 100 will build up as movement downward continues until the pressure counterbalances the weight, or until the head or foot section comes to rest against the support frame D, which is structurally capable of supporting it without damage.

When the pressure is the same in chambers 100 and 98, the force exerted by the piston rod 92 to the right of FIG. 9 will be the pressure times the cross sectional area of the rod 92 minus the frictional value of packings 101 and 96 Additionally, there will be some very small friction of the piston rod at slideway 91, and of the piston 94 against the cylinder walls 93 which will subtract from the total force. Whether the pressure will be the same or not in chambers 100 and 98 will be dependent upon the particular adjustment and circumstances of the gas spring installation. For example, if foundation section 3 is elevated and the operator rests his torso weight on it, the pressure will be greater in chamber 100 than it will be in chamber 98, although probably not by a very great amount. If the valve 104 is maintained in the open condition until the head or foot section that the particular gas spring is operating on comes to the end of its travel, then the pressure will definitely become equal on each side of the valve 104.

The devices 9 and 10 are pneumatically locked, but as is well known in the art, they are also available in hydraulically locked form.

Figure 5:
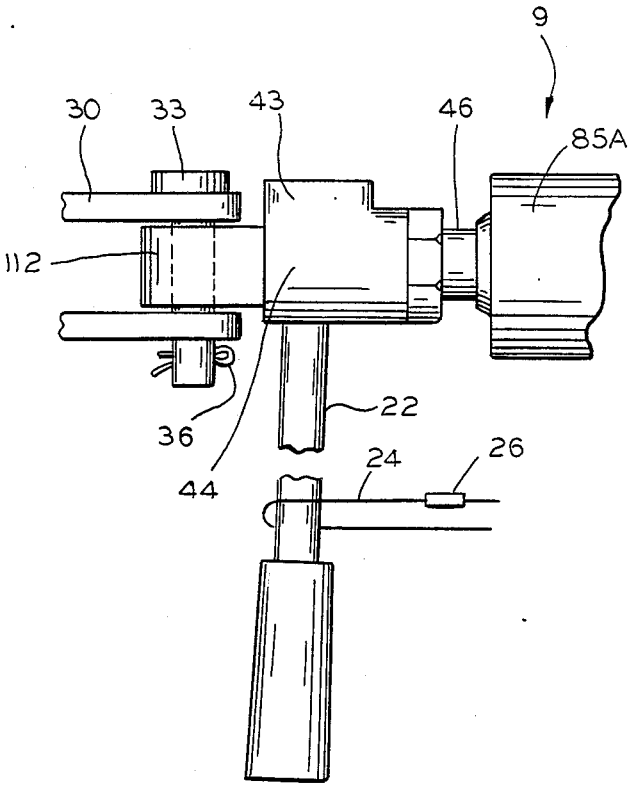
FIG. 5 is a diagrammatic fragmental view illustrating the manner in which, for the illustrated embodiment, the pivotal ends of the gas spring devices are mounted, and the arrangement that is provided in the illustrated embodiment to control the operating and locking operation of the respective gas spring deices.

For purposes of mounting the cylinder end 85A of the locking gas device 9 in operative position, the arrangement shown in FIG. 5 is employed, whereby the adapter 43 is apertured as at 114 to receive pin 33 that is in turn secured to the lugs of bracket 30 and held in place, as by, for instance, using suitable cotter key 36.

The valve member 104 is actuated, as indicated, through rod 116 by a suitable rock handle for moving rod 116 longitudinally, to the right of FIG. 9, relative to the end 85A of cylinder 90, for device 9, in accordance with the present invention; for the device 9 this is handle 22, while for the device 10, this is handle 23.

As is further illustrated in FIG. 6, the end 28 of the piston rod of a device 9 is secured to the torque applying bracket 11 employing suitable headed pin 33A held in place by suitable cotter key 36, with the pin 33A being applied to one of the bracket apertures 57 at the force receiving end of the bracket 11 (see FIG. 10), as selected by the installer, depending on the weight and stiffness of the mattress employed on a specified bed A (this can be later adjusted as needed).

The locking gas spring device 10 is the same as device 9, and the brackets 12 and 63 for device 10 are similarly but oppositely mounted, as indicated in FIGS. 1 and 4.

It will thus be seen that both the devices 9 and 10 are arranged such that the locking action of the gas spring involved in each is released by actuating valve member 104, utilizing, in the case of the device 9, handle 22, and in the case of the device 10, handle 23, with the valve member 104 in the case of device 9 being at the pivoting end 44 of the gas spring device 9, and valve ember 104 in the case of device 10 forming the pivoting end 44A of device 10. The movement applied to the valve members 104 of the respective devices 9 and 10 sufficiently moves the valve member 104 sealing portion 106 relative to the cylinder wall 109 to unlock the respective devices 9 and 10 to permit the gas flow that will extend or retract the devices 9 and 10, as contemplated by the present invention, and as hereinafter made clear.

Referring to FIG. 4, the arrangement is such that the indicated movement of the lock release arm or handle 22 releases the locking function of the gas spring device 9, where flow of the gas internally of device 9 permits shifting of the piston rod 92 relative to and lengthwise of its cylinder 90. This is effected by an operator manually hand grasping and manually pivoting either handle 13 of actuating control arm or shaft 21, either clockwise or counterclockwise, depending upon which locking gas device 9 or 10 is to be actuated. Assuming it is the device 9, rotation of either of the handles 13 of FIG. 4 in a counterclockwise direction relative to the axis of rod sections 19 tightens flexible cable loop 24 looped between the lever handle 22 and the apex 17 of the control arm 21 (which may also be termed a crank arm), and further loosens the corresponding flexible cable loop 25 that is associated with the handle 23 of the gas device 10. When the handle 13 at the right hand end of the device 21 has been rotated counterclockwise sufficiently, the lock indicated in FIG. 9 for gas spring device 9 will be released, with the result that the force of the high pressure gas flow acting on the piston 94 acts through piston rod 92 and bracket 11 to shift the foundation head section 3 upwardly in the manner indicated in FIG. 1 (unless the indicated foundation section 3 is opposed in such movement, as hereinafter described). By the operator merely releasing the indicated handle 13 so that it drops to the depending relation shown in FIG. 4, the locking valve 104 of the device 9 returns to locking relation, whereby gas flow within device 9 is precluded and the foundation head section 3 is held in the inclined position selected by the operator.

Where one of the handles 13 of the crank arm 21 is rotated clockwise of FIG. 4 sufficiently, the same locking releasing action will occur on the spring device 10, which if unopposed will achieve a inclined angulation of the foundation foot section 5 to the operator's satisfaction, after which the gas locking device 10 may again be locked to hold the foot section 5 in the desired position, by merely releasing the handle 13 actuated, so it returns to its depending relation shown in FIG. 4.

The crank arm 21, as indicated in FIGS. 3 and 4, has three rectilinear sections 19, 40, and 19, which are united in one piece form by the respective crank arms 20 that are proportioned in isosceles triangle form to define the respective crank arm apexes 17 and 56. The rectilinear sections 19 and 40 of crank arm 21 are rotatably secured in position on the underside of the stationary foundation section 4 by four suitable brackets 18 of the general type shown in FIG. 3A, with the brackets 18 being applied over the respective shaft sections 19, 40 and 19 in such a manner to allow the free rotary movement of crank arm 21 that has been indicated. The free rotary movement indicated for crank arm 21 is about its central axis that extends transversely of the foundation B (see FIGS. 1, 3 and 4); such crank arm axis has what may be termed a neutral position in which the locking valves 104 of cylinder devices 9 and 10 are both in locked relation, with handles 13, when both are free to return under gravity to the depending relation shown in FIG. 4, thus biasing the crank arm to return to such neutral position.

The respective brackets 18 (see FIG. 3A) each have two apertures 31 that receive appropriate screws (not shown) for securing the brackets 18 and thus the crank arm 21 to the underside of foundation section 4.

The respective cable loops 24 and 25 are lengths of a suitable flexible cabling cut to the length that will serve the purposes indicated, and the two ends of each length are threaded around the respective handles 22 and 23 and through the respective apexes 17 and 56 and are held together by suitable splice sleeve 26, with the cable being proportioned as needed so that each cable loop 24 and 25 has the proper amount of slack to perform in the manner indicated, after which the splice sleeve 26 is deformed to secure the cable of the respective loops 24 and 25 in place, using a suitable portable hand tool. The splices 26 and the hand tools for crimping same are readily available in any hardware store.

The bracket devices 11 and 12 are identical in function and can be of, to simplify manufacture and assembly, identical dimensionally. In the illustrated arrangement the bracket assemblies 11 and 12 are identical both in function and dimensionally, with the bracket assembly 11 being shown on a large scale in FIG. 10, from which it will be seen that the assembly 11 consists of two right angled pieces of sheet metal 52 and 53 (approximately 1/16th of an inch thick), and as indicated, bent at right angles. The pieces 52 and 53 are symmetrical but of opposite hand. They can be formed from the same pierced blank. The vertical sides of pieces 52 and 53 of the assembly 11 are separated by a piece of fiberboard 50 which serves as a core and joined together with bolts 64 making a sandwich of the three pieces involved. The fiberboard core 50 is preferably of the same type as that employed for foundation sections 3, 4 and 5. The leading edge of the bracket assembly 11 has a series of cross holes 57 in same so that, for instance, the gas spring device 9 can exert its force over different selectable radius lengths to permit the installer to vary the torque applied to the foundation section being positionally changed relative to section 4 by applying the mounting bolt 33A to variant sets of aligned apertures 57. Different weights and stiffness of mattresses require different forces to generate the torque needed to rotate the foundation head section 3 with respect to the foundation section 4; while four sets of aligned through holes 57 are shown on bracket assembly 11, these sets of holes can vary in number as needed, but the holes or apertures 57 should be in pairs elevationally of the bracket assembly 11 for appropriate mounting of the gas cylinder device pin 33A as indicated in FIG. 6 from the swing axis 14A (see FIG. 1). The bracket 11 is attached to the head section pad 15 by employing wood screws that are not shown that are applied through holes 62 formed in the base of the bracket assembly 11 (that is defined by metal pieces 52 and 53).

The bracket assembly 12 is arranged in a similar manner, as will be apparent from the showing of FIG. 4. Note in the assembly 12 there shown the steel pieces 54 and 55, the sandwich fiberboard piece 51, the cross holes 58 and the apertures 62 that secure the assembly 12 to the reinforcement pads 16 of foot section 5.

As indicated in FIG. 6, the piston rod 92 of the device 9 at its end 28 has an annular end piece 34 suitably affixed thereto which defines a cross hole to receive the indicated pin 33A whereby the force of the gas spring involved is transferred to the bracket assembly 11 that converts such force to the appropriate torque that is applied to foundation section 3. As indicated, the force exerted through the assembly 11 can be changed to accommodate different weights and stiffnesses of mattresses by altering the length of the radius (from swing axis 14A) that the gas spring device 9 acts through in acting on the section 3. Assembly 12 and associated parts are arranged in the same manner.

The end 29 of the piston rod 92 for the gas device 10 (see FIG. 4) likewise has an end piece (not shown) similar to the end piece 34 that receives a pin comparable to pin 33 and is likewise applied to bracket assembly 12 for modification (as by the installer) of the force t be applied to the foundation section 5 to accommodate different weight and stiffnesses of mattresses applied to the foundation B. Similar to the gas spring device 9, the gas spring device 10 involved has its end pivoting 44A connected by a similar pin 33 to bracket 63, as indicated in FIGS. 4 and 6. This pin 33 also has a cotter key 36 applied thereto to prevent removal in use. Again, the piston rod end piece of device 10 is applied to a set of aligned bracket apertures 58 that are suitably spaced from the swing axis 27A to accommodate the mattress variations indicated in practicing the invention.

As indicated in FIG. 4, the brackets 30 and 63 are identical and both have the apertures 59 for receiving mounting screws that fix same to the frame members 60 and 61, respectively, of the supporting platform D.

Figure 2:
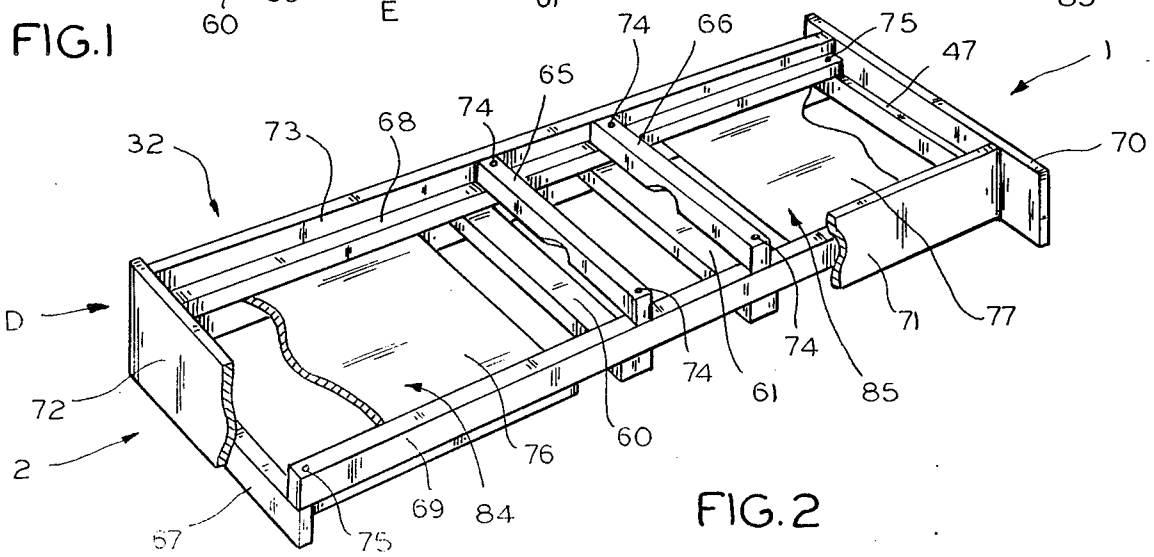

FIG. 2 is a perspective view of the base or platform D on which the adjustable mattress foundation B of this invention is to be mounted. The base or platform D comprises a framework 32 made of wood. The Applicants have found that structural wood members commonly referred to as 2 by 4's are acceptable insofar as size and strength are concerned for this particular application. The lumber involved should be clean and preferably kiln dried to achieve the low level of moisture desired for this application. A moisture content in the range of from about 11 per cent to about 14 per cent is acceptable though a moisture content of less than 11 per cent is even better.

In FIG. 2, the framework 32 is shown to be made up of standard lumber sections, secured together with carriage bolts. The fixed section 4 of the mattress foundation of this invention is fastened to suitable cross pieces 65 and 66 of frame 32 by suitable screws or adhesives, angle brackets or other suitable means. The cross pieces 65 and 66 on top and the cross pieces 60 and 61 on the bottom are fastened to the respective lengthwise frame supports 68 and 69 by employing suitable carriage bolts where indicated at 74. The cross pieces 47 and 67 are fastened to the lengthwise supports 68 and 69 by suitable carriage bolts where indicated at 75. The cross piece 47 is at the frame head end and a similar cross piece 67 is at the frame foot end. These members support the respective lengthwise supports 68 and 69.

The framework 32 can have either furniture glides or casters, not shown, one at each corner, and suitably mounted at the bottom of the respective cross pieces 47 and 67. The casters or glides facilitate movement of the bed when cleaning the bedroom or rearranging the furniture.

Referring again to FIG. 4, reference numeral 48 generally indicates a rectangular sheet of steel extending between and on the underside of the frame cross pieces 60 and 61. This piece of sheet steel (18 gauge being adequate) serves as a reinforcement to resist the action of distorting rotational forces on the cross pieces 60 and 61 as the weight of the patient is applied to the bed in the inclined position of mattress sections 3 and 5. Sheet 48 can be attached to the underside of braces 60 and 61 in any suitable manner, as by employing wood screws (not shown). Sheet 48 is located at the approximate center line of the bed A. While there are obviously many ways to reinforce this part of the bed supporting framework, the reinforcing function provided by sheet 48 is both effective and economical.

The bed framework is shown in FIG. 2 to be faced with pieces 70, 71, 72 and 73 of fiberboard or other wood products. The Applicants have found that ¾ inch thick particle board of medium density is acceptable for this purpose. Such fiberboard can be faced with a thin film on all its surfaces that are normally viewed, and can be painted or embossed with artificial wood grain. These pieces serve several quite useful functions. Thus the piece 70 at the head end of the bed A can serve as a means to attach a headboard. These four pieces thus become the sides of a "box". If pieces of a sheet of a wood product such as masonite or its equivalent forming parts 76 and 77 are fastened to the bottom of the frame parts 68 and 69, the box has a bottom. Thus, when the foundation sections 3 and 5 are in a horizontal position, the box involved is covered, but when the sections 3 and 5 are elevated, the box is exposed and becomes a convenient receptacle for storage purposes for such items as sheets, blankets, pillow cases, etc. In addition to the utility provided at virtually no cost that the pieces 70, 71, 72, 73, 76 and 77 give the bed A, they make the adjustable mattress foundation assembly quite attractive as a piece of furniture. The storage space involved is indicated at 84 for the foot end of the bed A with the foot section elevated. The storage section is similar (and is indicated at 85) for the head end, as will be apparent, with FIG. 1 showing the location of both storage sections being identified by reference numerals 84 and 85.

Figure 7:
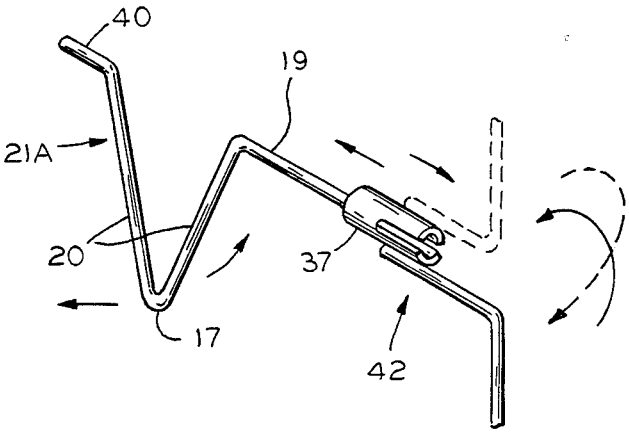
FIG. 7 is a fragmental perspective view illustrating an alternate arrangement for the control rod and its handles.
Figure 8:
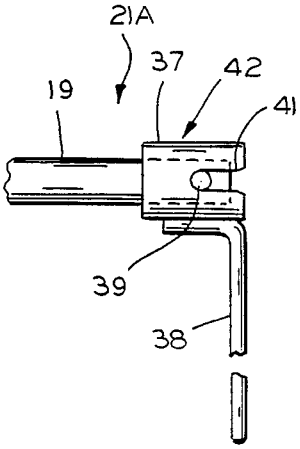
FIG. 8 is a fragmental elevational view of the adjustable handle arrangement shown in FIG. 7.

Referring now to the alternate crank arm 21A of FIGS. 7 and 8, this arrangement has provision for the handles 38 of same to be operated either in the up or down position. FIGS. 7 and 8 show one end of the alternate crank arm 21A (both of the rectilinear sections 19 are arranged in the manner shown in FIGS. 7 and 8); in this embodiment, such sections 19 are shortened and have holes drilled near the ends of same for receiving a conventional spring pin 39. The respective sections 19 also receive a sleeve 37 in free sliding relationship thereto that has a slot 41 cut into it on both sides at one end of same in which the spring pin 39 may be received. A suitable L shaped handle 38 is suitably affixed to the tubular section 37, as by employing welding techniques or the like to form a handle lock release assembly 42. When it is desired to rotate the alternate crank arm 21A, the assembly 42 is positioned upright or allowed to depend in one of the manners indicated in FIG. 7 and moved laterally outwardly of the bed to dispose the pin 39 within the cross slot 41 of sleeve 31, whereby the crank arm 21A may be rotated as described hereinbefore. The spring pins 39 are commonly available fasteners that fit into a hole that is slightly smaller than the outside diameter of the spring pin itself. They are insertable into the hole by striking with hammer or pressed in with suitable tooling and exert a force against the side walls of the hole in which they are in so that they remain in place in normal usage. By sliding the assembly 42 towards the longitudinal center line of the bed until the spring pin is no longer engaged in the slot 41, the assembly 42 can be rotated 180 degrees and slid away from the center of the pad to reengage the spring pin within the slots 41 of member 37, where one desires to change the position of the operating handle 38 180 degrees.

Referring now to the bed modification $A_1$ of FIG. 11, in this embodiment, a foam pad 79 having a length roughly equivalent to the full length of the foundation B sections in coplanar relation and as hinged together, and a width roughly equaling the maximum transverse dimension of foundation sections 3, 4, and 5, is laid upon the foundation B and then covered with a cloth box in upside down relation that has its open side stapled to the undersides of the foundation sections 3, 4, and 5, that forms the mattress $C_1$ that is to have the position shown in FIG. 1 with respect to frame D and the mattress foundation B. Reference numeral 80 indicates the fabric box (as a whole) that covers the top and sides of the foam pad 79, while reference numeral 81 indicates the box top cover and reference numeral 82 indicates the bead formed where the fabric box top cover 87 and the box side cover 83 are sewn together. In this embodiment, the side cover 83 extends an inch or two down past the foundation sections 3 (see FIG. 12), 4 and 5, and is folded back over the undersides of the sections 3, 4 and 5 (where indicated at 84) and stapled, tacked, glued, or otherwise secured to the undersides of the indicated foundation sections 3, 4 and 5 before the assembly of the resulting mattress-foundation assembly H to the frame D.

The foam pad 79 serves as a substitute for a box spring, but is superior to a box spring for this particular application, in being more flexible. Nevertheless, the mattress foundation B of this invention functions quite satisfactorily without either the foam pad or a box spring, and with a suitable conventional mattress applied thereto.

OPERATION

Assuming that a bed A has been assembled in the manner indicated in FIG. 1, and the mattress foundation B is in the planar position indicated in full lines in FIG. 1, with the sections 3 and 5 thereof in coplanar relation with the section 4, the adjustable bed that results may be operated as follows:

In order to adjust the foundation head section 3 on its hinge defined swing axis 14A, the individual doing this can be the patient lying on the bed A, or standing up beside the bed. If the operator is, for instance, a patient lying on the bed, the patient first leans forward enough so that his weight is not supported by that part of the mattress C located over the foundation section 3. The patient then reaches over one side of the bed and grasps the handle 13 of the crank arm 21 that is there located, and operates the locking gas cylinder arrangement that is to appropriately tilt the foundation section 3, which for the illustrated embodiments is the device 9. For this purpose the crank arm 21 is to be pivoted counterclockwise of FIGS. 1 and 4, regardless of which handle 13 of crank arm 21 is grasped by the patient, which results in the crank arm 21 tensioning the cable loop 24 by way of the crank arm apex 17 to throw the actuating arm 22 and rod 116 that abuts the valve member 104 of device 9 sufficiently to effect release of the gas lock and transfer of gas under pressure from the device subchamber 98 to the device subchamber 100 through the passage 102 by virtue of the cocking action that is achieved on actuation arm 22, whereby the high pressure gas entering the subchamber 100 shifts the piston 94 toward the right of FIGS. 4 and 9 to tilt the foundation section 3 upwardly as desired, for instance, to the maximum position indicated in FIG. 1, or any inclined position short of such maximum, whereupon the handle 13 of the crank arm 21 that has been so pivoted is manually released to drop to the depending position indicated in FIG. 4, whereby the valve member 104 is internally biased to return to its locking relation within the device 9, and the piston 94 thereof is again locked to hold the section 3 in the desired position of inclination, for instance the position **3*a* indicated in FIG. 1**.

The foundation head section 3 may be lowered by the patient who is reclining on bed A leaning against the mattress portion overlying same allowing his weight from the hips up to be completely supported by the foundation section 3, and again pivots the handle crank arm 21 counterclockwise as needed to release the valve member 104 of device 9, whereby the head section then lowers by the patient's indicated weight alone, and back to the initial position of FIG. 1, which is in coplanar relation with the stationary section 4 (and rests on the frame D), after which the crank arm handle 13 is again released to gravitate back to the depending relation of FIGS. 1 and 4 so that the locking gas device valve member 104 returns to its locking relation within the device 9, and the chamber 98 of the indicated cylinder 90 (of device 9) is pressurized accordingly.

It will be apparent that a position of inclination of section 3 between the starting of the lowering of such section 3 and the horizontal position for same can be obtained by merely manually releasing one's grip on the crank arm handle 13, which gravitates back to the starting position, and allows the internal locking mechanism of the locking gas spring device 9 to resume its normal biased locking condition.

It will be understood that during the operation of the adjustable bed A that has been indicated, the cable loop 25 that receives the arm 23 of the device 10 is moved in the opposite direction and thus the locking of the device 10 is unaffected.

Where the operator is standing by the bed A (rather than reclining on it) and wishes to adjust the head section 3 to lower same from the maximum position of FIG. 1, such person places one hand against such head section 3 or the portion of mattress C overlying same, exerting his weight against it, and also pivots counterclockwise a handle 13 of crank arm 21 with his other hand, so that the gas flow lock of device 9 is released and the head section 3 returns to horizontal position under the thrust applied to head section C. Release of the particular handle 13 of the crank arm 21 that has been grasped returns the gas flow locking relation to the device 9. If the head section 3 is to be raised from a position intermediate the maximum inclined relation and the horizontal relation shown on FIG. 1, again when a handle 13 of crank arm 21 is grasped to rotate the crank arm 21 in the indicated counterclockwise direction to unlock the gas flow of the device 9, the higher pressure gas flow entering the chamber 100 acts on the piston rod 92 of the device 9 to raise the section 3 to the inclination desired (up to the maximum provided for), after which the grasped handle 13 is then released to gravitate to the depending position indicated in FIG. 4 whereby the foundation section 3 is automatically locked in the position of desired inclination or the horizontal position, as the case may be.

For a person standing next to the bed A to raise and lower the foot section 5 of the mattress foundation B and the portion of the mattress C overlying same, the same procedure is followed as for raising and lowering the foundation head section 3, except that the handle 13 of the crank arm 21 is pivoted in the opposite arcuate direction for each motion of the foot section that is desired (raising or lowering). The procedure indicated effects locking and unlocking of the gas flow lock of the gas pressure device 10 that is achieved by the tensioning of the cable loop 25 against the handle 23 for actuation of the locking valve 104 of the device 10, the cable loop 24 being relaxed in the direction of rotation that is involved for raising and lowering the foundation foot section.

Upward swinging movement of the foundation foot section and the portion of mattress C overlying same, when the patient is lying on the bed, is accomplished by the patient first moving his buttocks toward the head end so that the patient's weight is supported by foundation sections 3 and 4, and his extended legs are lifted so that there is none of the patient's weight on the section 5. Then one of the handles 13 of the crank arm 21 is pivoted clockwise of FIG. 4 to achieve unlocking of the lock of the device 10 whereby the high pressure gas of the device 10 chamber 98 enters subchamber 100 of the device 10 to effect tilting of the foundation section 5 about the tilt axis 27A defined by the hinges 27. When the desired elevation has been reached, the patient releases his grip on the handle 13 of crank arm that has been grasped, so the crank arm gravitates back to the start position of FIGS. 1 and 4, and the foundation foot section 5 (and the portion of the mattress overlying same) will be locked into that position. The foot section 5 can be lowered by the patient bending his legs at the knee joint to an approximate angle of 90 degrees, pivoting one of the crank arm handles 13 clockwise, and pushing downwardly with his feet. When the foot section 5 is rotated back to a desired lesser inclination for the horizontal position, the patient's grip on the handle 13 that has been grasped is released, and the foundation section 5 involved remains at the desired angle relative to the stationary section 4.

The crank arm 21, the cable loops 24 and 25, the arms 22 and 23, and the respective rod members 116 and valve members 104 of the respective devices 9 and 10 form a mechanism E to release the locks of both the locking gas devices 9 and 10 employed, whereby the locking arrangements of the respective devices 9 and 10 are linked together so that a single crank arm 21 controls the locking movement of both gas springs, utilizing either one of the handles 13 of same. The mechanism involved, generally indicated by reference character E of FIG. 4, has a neutral position to which the crank arm 21 returns under gravity, wherein the handles 13 of same are both in a more or less vertical depending relation with respect to the foundation B. Pivoting the crank arm 21 in either direction (clockwise or counterclockwise of FIG. 4) will release the lock of one of the gas spring devices, with the direction of rotation determining which spring device will be so operated, and of course, which foundation section will be activated.

As indicated by the modification of FIGS. 7 and 8, the crank arm 21 may be in the form of crank arm 21A so that the crank arm handles 38 may be disposed in the upright vertical position or in the depending vertical position in the neutral position of the device, as desired. Also, the adjustable bed may have a mechanism E for only the head section 3, or only the foot section 5, of the bed, if so desired.

Should the Gas Spring Corporation gas lock device be employed in place of devices 9 and 10, the operation is similar but the gas spring lock unit should be applied to the foundation B in the relations of the similar units herein specifically disclosed as devices 10 and 9, respectively; in other words, the position of the Gas Spring Corporation devices should be reversed from the position of the gas spring devices shown for devices 9 and 10, as in these conventional, off the shelf items, the gas lock valve operating pin is in the piston rod and the remaining components are oriented accordingly.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

We claim:

1. An adjustable foundation for bed mattresses and operable by the bed user, said foundation comprising:

a head section articulated to a center section, said sections each comprising a generally planar member extending longitudinally of said foundation, means for mounting said center section in a stationary, substantially horizontal position, said center section having opposite sides that extend longitudinally of said foundation and are spaced apart across the width of said foundation, with said head section being hinged to one side of said center section for swinging movement with respect thereto about an axis extending transversely of said foundation, means for selectively moving said head section relative to said center section in a predetermined movement range between a position of substantially coplanar relation with said center section and positions that are upwardly inclined relative to said center section, means for locking said head section at said coplanar relation position, and at all other selected positions that are in said movement range of said head section, said moving and locking means for said head section comprising a locking type fluid cylinder device for said head section, said cylinder device being disposed and mounted below said foundation center section, and having one end of same fixed relative to said foundation center section and the other end of same in torque transmitting relation relative to said head section for swinging said head section about said axis to move said head section from said position to selected of said positions within its said movement range when said cylinder device is unlocked, said cylinder device including means for unlocking same for said selected movement of said head section from said position to and between said positions, and means for selectively controlling said movement of said head section and comprising:

a crank arm extending transversely of and below said foundation intermediate said center section and between said opposite sides of said center section and having a pivotal axis extending transversely of said foundation, said crank arm defining adjacent each of said center section opposite sides a handle portion for selectively pivoting same by the bed user from either such handle portion from a bed user position lying on the bed, and from a selected one of said sides of said center section, said crank arm axis having a neutral pivotal position, means connecting said crank arm to said cylinder device unlocking means for activating said cylinder device in only one direction of pivoting of said crank arm from said neutral position thereof and for returning said cylinder device to locked relation when said crank arm is returned to said neutral position, and means for biasing said crank arm for pivoting same back to said neutral position on completion of said selected actuation of said cylinder device.

2. The adjustable foundation set forth in claim 1 wherein:

said sections are of generally quadrilateral configuration.

3. The adjustable foundation set forth in claim 1 wherein:

said foundation is supported on a platform to which said center section is fixedly anchored.

4. The adjustable foundation set forth in claim 3 wherein:

said foundation supports a bed mattress that is substantially coextensive therewith.

5. The adjustable foundation set forth in claim 1 wherein:

said cylinder device other end is connected to said head section for adjusting the thrust applied to said head section, to move same within said movement range to accommodate same for variant weights and stiffnesses of mattresses to be applied to said foundation.

6. An adjustable foundation for bed mattresses and operable by the bed user, said foundation comprising:

a head section and a foot section articulated to a center section, said sections each comprising a generally planar member extending longitudinally of said foundation, means for mounting said center section in a stationary, substantially horizontal position, said center section having opposite sides that extend longitudinally of said foundation and are spaced apart across the width of said foundation, with said head and foot sections being hinged to opposite sides of said center section for swinging movement with respect thereto about substantially parallel axes extending transversely of said foundation, means for selectively moving said head and foot sections relative to said center section in predetermined movement ranges between a position of substantially coplanar relation with said center section and positions in said respective movement ranges that are upwardly inclined relative to said center section, means for locking said head and foot sections, respectively, at said coplanar relation positions, respectively, and at all other selected positions in said movement ranges of said head and foot sections, respectively, said moving and locking means for said respective head and foot sections comprising a first locking type fluid cylinder device for said head section, and a second locking type fluid cylinder device for said foot section, said cylinder devices being disposed and oppositely mounted below said foundation center section and having one end of each fixed relative to said foundation below said center section, and the other end of said first cylinder device in torque transmitting relation relative to said head section, and the other end of said second cylinder device in torque transmitting relation relative to said foot section, for respectively and selectively swinging said head and foot sections about their respective axes to move same within their respective movement ranges when the respective cylinder devices are unlocked, said first cylinder device including means for unlocking same for said selected movement of said head section from the said coplanar relation position of same to and between said positions of same in the predetermined movement range of said head section, and said second cylinder device including means for unlocking same for said selected movement of said foot section from the said coplanar relation position of same to and between said positions of same in the predetermined movement range of said foot sections, and means for selectively controlling said movement of said head and foot sections, respectively, and comprising:

a crank arm extending transversely of said foundation intermediate said center section and between said opposite sides of said center section and having a pivotal axis extending transversely of said foundation, said crank arm defining adjacent each of said center section opposite sides a handle portion for selectively pivoting same by the bed user from either such handle portion from a bed user position lying on the bed, and from a selected one of said sides of said center section, said crank arm axis having a neutral pivotal position, means for connecting said crank arm to said first cylinder device unlocking means for activating said first cylinder device in only one direction of pivoting of said crank arm from said neutral position thereof and for returning said first cylinder device to locked relation when said control arm is returned in the opposite direction to said neutral position, means for connecting said crank arm to said second cylinder device unlocking means for activating said second cylinder device in such opposite direction of pivoting said crank arm from said neutral position and for returning said second cylinder to locked relation when said control arm is returned to such neutral position, and means for biasing said crank arm for pivoting same back to said neutral position on completion of said selected actuation of said cylinder devices, respectively.

7. The adjustable foundation set forth in claim 6 wherein:

said sections are of generally quadrilateral configuration.

8. The adjustable foundation set forth in claim 6 wherein:

said foundation is supported on a platform to which said center section is fixedly anchored.

9. The adjustable foundation set forth in claim 8 wherein:

said foundation supports a bed mattress that is substantially coextensive therewith.

10. The adjustable foundation set forth in claim 6 wherein:

said cylinder devices at their said other ends are respectively connected to the respective head and foot sections for adjusting the thrust applied to the respective head and foot sections, to move same within their respective movement ranges, to accommodate same for variant weights and stiffnesses of mattresses to be applied to said foundation.

* * * * *